US010039316B2

(12) United States Patent
Kato

(10) Patent No.: US 10,039,316 B2
(45) Date of Patent: Aug. 7, 2018

(54) CIGARETTE FILTER MANUFACTURING APPARATUS AND CIGARETTE FILTER MANUFACTURING METHOD

(71) Applicant: JAPAN TOBACCO INC., Tokyo (JP)

(72) Inventor: Katsuo Kato, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 530 days.

(21) Appl. No.: 13/971,400

(22) Filed: Aug. 20, 2013

(65) Prior Publication Data

US 2013/0337987 A1 Dec. 19, 2013

Related U.S. Application Data

(63) Continuation of application No. PCT/JP2011/053716, filed on Feb. 21, 2011.

(51) Int. Cl.
*B31C 99/00* (2009.01)
*A24D 3/02* (2006.01)

(52) U.S. Cl.
CPC ..... *A24D 3/0241* (2013.01); *A24D 3/0212* (2013.01)

(58) Field of Classification Search
CPC .... A24D 3/0204; A24D 3/022; A24D 3/0229; A24D 3/0233; A24D 3/061; A24D 3/0212; A24D 3/0216; A24D 3/0225; A24D 3/04; A24D 3/02; A24D 3/0241; A24D 3/0245; A24D 3/0258; A24D 3/0287; A24D 3/0295; A24D 3/041; A24D 3/043; A24D 3/048; A24D 3/063; A24D 3/14; A24D 3/163
USPC ..... 493/39, 42, 45–48, 50, 44
See application file for complete search history.

(56) References Cited

U.S. PATENT DOCUMENTS 2,039,298 A * 5/1936 Davidson ..... A24D 3/0204 131/361
2,164,702 A * 7/1939 Davidson ..... A24D 3/0245 131/340
2,202,839 A * 6/1940 Davidson ..... A24D 3/02 131/340
3,064,541 A * 11/1962 Mantchev ..... A24C 5/476 493/45

(Continued)

FOREIGN PATENT DOCUMENTS

CH 661 412 A5 7/1987
EP 2 110 031 A1 10/2009

(Continued)

OTHER PUBLICATIONS

Extended European Search Report, dated Feb. 21, 2017, for European Application No. 11859523.0.

*Primary Examiner* — Hemant M Desai
*Assistant Examiner* — Eyamindae Jallow
(74) *Attorney, Agent, or Firm* — Birch, Stewart, Kolasch & Birch, LLP

(57) ABSTRACT

A cigarette filter manufacturing apparatus, includes, a stuffer jet which sends a tow together with air, a tongue which molds the tow into a bar, a convergence guide which is provided in a position between the stuffer jet and the tongue, and converges the tow while guiding the tow toward the tongue, and a plurality of thread introducing tubes, intervals between which are reduced toward downstream in a position between an outlet of the stuffer jet and an introducing part of the tongue, the thread introducing tubes supplying respective threads into the tow from respective downstream distal ends.

11 Claims, 4 Drawing Sheets

(56) References Cited

U.S. PATENT DOCUMENTS 3,844,200 A * 10/1974 Sexstone ..... A24D 3/0225 131/344
4,355,995 A * 10/1982 Berger ..... A24D 3/043 493/43
4,549,875 A * 10/1985 Pryor ..... A24D 3/022 493/44
4,676,769 A * 6/1987 Bahr ..... A24D 3/0295 156/361
4,776,351 A * 10/1988 Wahle ..... B05B 5/14 131/69
5,106,357 A * 4/1992 Kampen ..... A24D 3/0233 493/44
5,203,757 A * 4/1993 Kampen ..... A24D 3/0233 131/336
5,331,976 A * 7/1994 St. Pierre ..... A24D 3/0233 131/96
6,783,617 B2 * 8/2004 Lorenzen ..... A24D 3/0204 156/178
6,908,421 B2 * 6/2005 Koborinai ..... A24D 3/022 493/39
7,115,085 B2 * 10/2006 Deal ..... A24D 3/0216 131/275
7,547,271 B2 * 6/2009 Kato ..... A24D 3/0225 493/4
7,740,019 B2 * 6/2010 Nelson ..... A24D 3/0229 131/335
7,770,585 B2 * 8/2010 Fowles ..... A24D 3/022 131/331
8,381,736 B2 * 2/2013 White ..... A24C 5/1892 131/335
2003/0224918 A1 * 12/2003 Lanier, Jr. ..... A24D 3/022 493/39
2008/0029118 A1 2/2008 Nelson et al.
2009/0090372 A1 * 4/2009 Thomas ..... A24D 3/0216 131/94
2010/0152008 A1 6/2010 Lanier, Jr. et al.
2011/0190105 A1 * 8/2011 Fallon ..... A24C 5/475 493/39
2011/0220134 A1 * 9/2011 Duke ..... A24D 3/048 131/331
2012/0115696 A1 * 5/2012 Davis ..... A24D 3/0229 493/39
2012/0122639 A1 * 5/2012 Davis ..... A24D 3/0212 493/39
2014/0171281 A1 * 6/2014 Park ..... A24D 3/0258 493/42

FOREIGN PATENT DOCUMENTS

EP 2 123 180 A1 11/2009
JP 54-37900 A 3/1979
JP 59-13184 B2 3/1984
JP 2005-521399 A 7/2005
JP 2010-504736 A 2/2010
WO WO 2010/108739 A1 9/2010
WO WO 2010108739 A1 * 9/2010 ..... A24D 3/0212

* cited by examiner

CIGARETTE FILTER MANUFACTURING APPARATUS AND CIGARETTE FILTER MANUFACTURING METHOD

CROSS REFERENCE TO RELATED APPLICATIONS

This application is a Continuation Application of PCT Application No. PCT/JP2011/053716, filed Feb. 21, 2011, the entire contents of which are incorporated herein by reference.

BACKGROUND OF THE INVENTION

1. Field of the Invention

The present invention relates to an apparatus for manufacturing a cigarette filter including a string impregnated with a flavoring or the like, and a method of manufacturing the cigarette filter.

2. Description of the Related Art

For example, a cigarette which achieves unique flavor by extending a plurality of threads impregnated with menthol through a filter, and an apparatus of manufacturing the cigarette filter are disclosed. The cigarette filter manufacturing apparatus comprises a duct-like tongue having a tapering shape, a convergence guide which is provided more upstream than the tongue and configured to supply a filter tow to the tongue, a plurality of cylindrical needles which supply threads impregnated with menthol or the like into the tongue, and a stuffer jet which feeds the filter tow to the convergence guide by using air pressure.

The needles are arranged from the outside of the tongue into the tongue, in an oblique direction, not a direction perpendicular to the central axis of the tongue. A plurality of threads which are fed through the needles are conveyed together with the filter tow, and arranged in predetermined positions in the filter (see Patent Literature 1).

In addition, there is a cigarette filter manufacturing apparatus which supplies a thread to a filter tow by a thread supply tube. In this example, in the tongue, a thread is supplied from below to the filter tow, and thereby a filter in which the thread extends through a cross section thereof is formed (see Patent Literature 2).

In the same manner, there is another example of a cigarette filter manufacturing apparatus, which supplies a thread to a filter tow by a thread supply tube. In the apparatus, a thread is supplied from above to a flow of the filter tow, and thereby a filter in which the thread extends through a cross section thereof is formed (see Patent Literature 3).

PRIOR ART LITERATURE

Patent Literature

Patent Literature 1: International Publication No. 2010/108739A1

Patent Literature 2: Jpn. PCT National Publication No. 2005-521399

Patent Literature 3: Jpn. PCT National Publication No. 2010-504736

BRIEF SUMMARY OF THE INVENTION

Technical Problem

In Patent Literature 1, however, the filter tow in the tongue is continuously pulled downstream by a garniture tape. Thus, when the needles are simply arranged obliquely toward the inside of the tongue as described above, the threads tend to gather toward the central axis of the tongue. So, it is difficult to arrange the threads to disperse at regular intervals in a cross section of the filter.

In addition, although a plurality of threads may be supplied by using the single thread supply tube in the apparatuses of Patent Literatures 2 and 3, no measures can be taken for the density of the filter tow, and consequently the threads undesirably crowd. In addition, since the apparatuses have the structure in which a thread is supplied to the filter tow from above or below, there is the problem that a plurality of threads are concentrated to a peripheral part of the filter.

Solution to Problem

A cigarette filter manufacturing apparatus according to an embodiment of the present invention comprises a stuffer jet which feeds a tow together with air, a tongue which molds the tow into a bar, a convergence guide which is provided in a position between the stuffer jet and the tongue, and converges the tow while guiding the tow toward the tongue, and a plurality of thread introducing tubes which extend in a position between an outlet of the stuffer jet and an introducing part of the tongue such that intervals between the thread introducing tubes are gradually reduced toward the downstream, and supply respective threads into the tow from their downstream distal ends.

A method of manufacturing a cigarette filter according to an embodiment of the present invention comprises: supplying a plurality of threads from distal ends of thread introducing tubes which extend in a position between an outlet of the stuffer jet and an introducing part of the tongue such that intervals between the thread introducing tubes are gradually reduced toward the downstream; and molding the tow including the threads into a bar in the tongue.

Advantageous Effects of Invention

According to the above structure, it is possible to provide a cigarette filter manufacturing apparatus and a cigarette filter manufacturing method, which enable arrangement of threads at regular intervals in the filter.

DETAILED DESCRIPTION OF THE INVENTION

Figure 1:
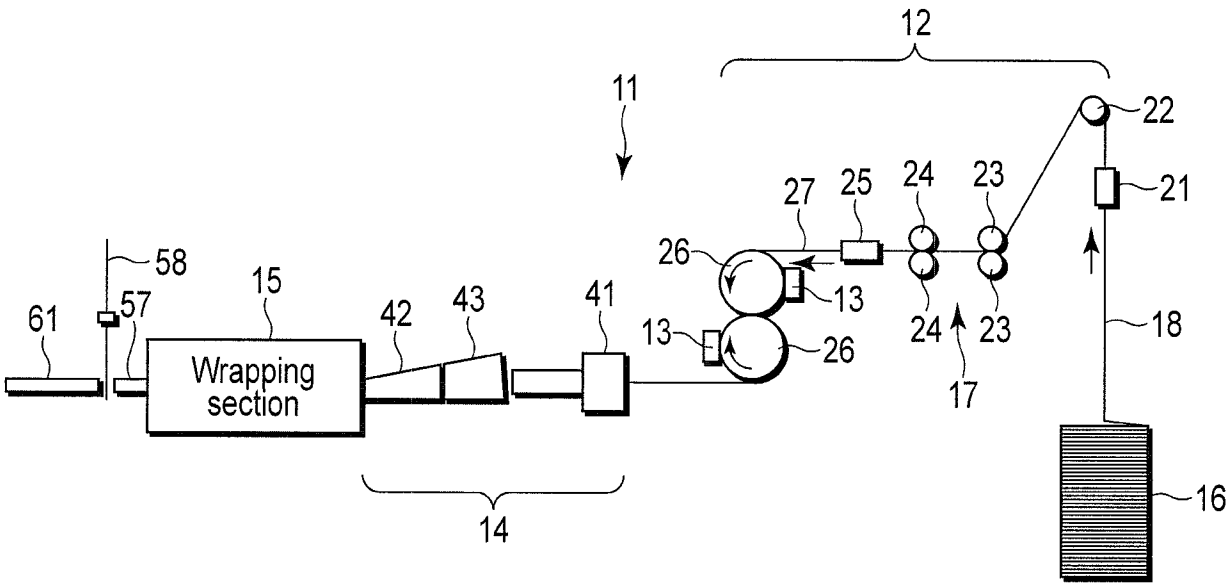
FIG. 1 is a side view of a cigarette filter manufacturing apparatus according to the present embodiment.

As illustrated in FIG. 1, a cigarette filter manufacturing apparatus 11 comprises a tow processing section 12, a plasticizer transfer section 13, a molding section 14, and a wrapping section 15, as an example.

The tow processing section 12 includes a bail 16, which contains a filter material formed of cellulose acetate fibers, that is, tow, and a tow channel 17 extends from the bail 16. A primary banding jet 21, a guide roller 22, a pair of pretension rollers 23, a pair of blooming rollers 24, a secondary banding jet 25, and a pair of feeding rollers 26 are arranged in this order from the bail 16 in the tow channel 17, and the feeding rollers 26 are arranged at the end of the tow channel 17.

When a tow 18 which is sent out of the bail 16 passes through the primary banding jet 21, the primary banding jet 21 jets out compressed air from the bail 16 toward the tow 18. The compressed air jetted increases (spread) intervals between fibers of the tow 18, and moderately stretches crimps of the tow 18.

The pretension rollers 23 provides the tow 18 with predetermined tension in cooperation with the blooming rollers 24, to further stretch the crimps of the tow 18. The blooming rollers 24 feed the tow 18, in which intervals between fibers have been increased, to the secondary banding jet 25.

The secondary banding jet 25 jets out compressed air toward the bundle of the tow 18, and further increases intervals between fibers of the bundle. As a result, the bundle of the tow 18 spreads in a width direction of the tow channel 17, and forms a flat filter web 27. Thereafter, the filter web 27 passes through the feeding rollers 26. A plasticizer such as triacetin is transferred in advance to the feeding rollers 26 by the plasticizer transfer section 13. When the feeding rollers 26 send the filter web 27 (tow 18), the forwarding rollers 26 can supply the transferred plasticizer to the filter web 27.

The filter web 27 (tow, that is, cellulose acetate fibers), to which the plasticizer has been added, is provided with adhesiveness by the effect of dissolution of acetate by the plasticizer. Bonding points which are bonded by adhesiveness are formed in a plurality of positions between adjacent acetate fibers. The filter web 27 (tow 18) is sent to the stuffer jet 41 of the molding section 14 by the feeding rollers 26. A spray nozzle may be provided above the filter web 27 in a position between the feeding rollers 26 and the stuffer jet 41, and the plasticizer may be sprayed on the filter web 27 from the spray nozzle.

Figure 2:
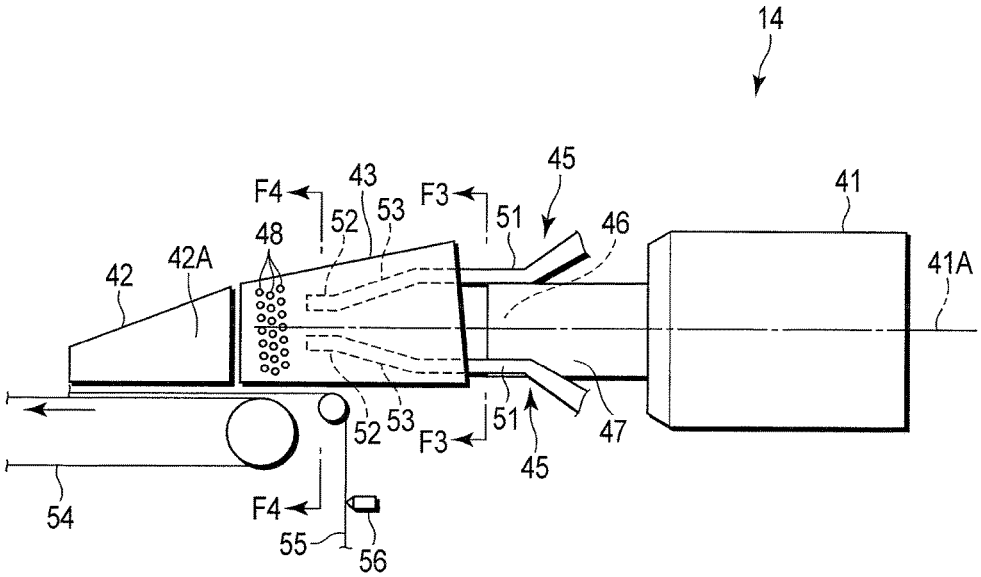
FIG. 2 is an enlarged side view of a part of the cigarette filter manufacturing apparatus illustrated in FIG. 1, including a convergence guide.

As illustrated in FIG. 2, the molding section 14 includes a stuffer jet 41 which sends the tow 18 (filter web 27) to the tongue 42 together with air, a tongue 42 which molds the tow 18 into a bar, a convergence guide 43 (trumpet guide) provided in a position between the stuffer jet 41 and the tongue 42, and a plurality of thread introducing tubes 45 configured to supply threads 44 to the tow 18 in the convergence guide 43.

The stuffer jet 41 includes an outlet 46, from which the tow 18 is discharged, and an edge part 47 which defines the periphery of the outlet 46. The convergence guide 43 includes a plurality of air vents 48 to let the air out. The convergence guide 43 has a roughly funnel shape. The convergence guide 43 can converge the tow 18 to a certain degree, while guiding the tow 18 sent from the stuffer jet 41 toward the tongue 42. As illustrated in FIG. 2, a space between the outlet 46 of the stuffer jet 41 and the convergence guide 43 has a half-closed state in which a channel for feeding the tow 18 is surrounded by the thread introducing tubes 45.

Although there are three thread introducing tubes 45 in the present embodiment, this number is not limited. Two or four thread introducing tubes 45 may be used. Each thread introducing tube 45 is formed in a cylindrical shape by, for example, a metal material. Threads 44 (string) run through the respective thread introducing tubes 45, and thereby the threads 44 can be supplied to the tow 18 running through the convergence guide 43. The threads 44 may contain a flavoring, such as a menthol flavoring solution and a tobacco extracted solution, or may be colored with any color. The threads 44 may be impregnated with different types of flavorings or colored with different colors, or the same flavoring or color.

Figure 3:
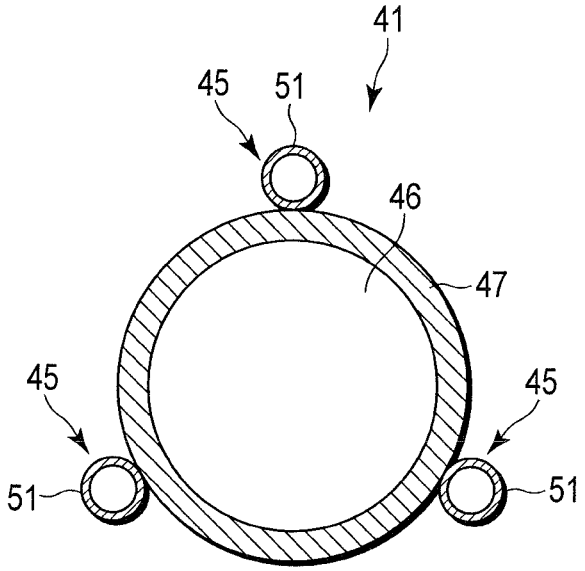
FIG. 3 is a cross-sectional view taken along line F3-F3 illustrated in FIG. 2.

As illustrated in FIG. 2 and FIG. 3, the thread introducing tubes 45 are arranged at regular intervals in three positions, for example, around the outlet 46 of the stuffer jet 41. Each thread introducing tube 45 includes a fixed part 51 which is fixed onto the edge part 47 of the stuffer jet 41, a distal end 52 which extends from the fixed part 51 toward the convergence guide 43, and a bent part 53 which connects the fixed part 51 with the distal end 52. The fixed part 51 is fixed by welding or the like onto the edge part 47 of the stuffer jet 41.

Figure 4:
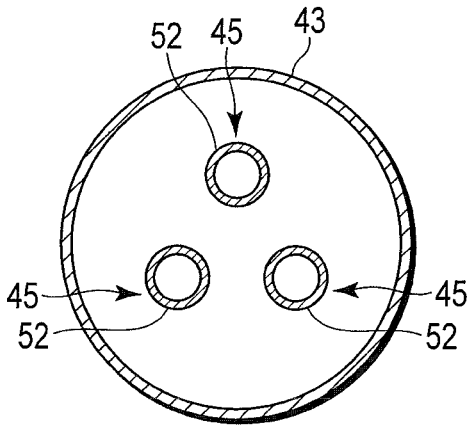
FIG. 4 is a cross-sectional view taken along line F4-F4 illustrated in FIG. 2.

The distal end 52 is provided in a position between the outlet 46 of the stuffer jet 41 and an introducing part 42A of the tongue 42, more specifically, inside the convergence guide 43. The distal end 52 extends in a direction parallel with (parallel with the stream of the tow 18) a central axis 41A of (the outlet 46 of) the stuffer jet 41. The bent part 53 extends from the fixed part 51 in a direction parallel with the stuffer jet 41, and then obliquely extends to go toward a radial inside of the stuffer jet 41. Specifically, intervals between the bent parts 53 are reduced toward the downstream in a position between the outlet 46 of the stuffer jet 41 and the introducing part 42A of the tongue 42. In addition, the distal end 52 of each thread introducing tube 45 is provided in a position inner than the edge part 47 of the stuffer jet 41. As illustrated in FIG. 4, although the distal ends 52 of the thread introducing tubes 45 are arranged inner than the edge part 47, a space is provided among the distal ends 52. Thus, tow 18 of a fixed amount can pass through the space among the distal ends 52 of the thread introducing tubes 45.

As illustrated in FIG. 2, the tongue 42 further compresses the tow 18 sent from the convergence guide 43, and can mold the tow 18 into a rod member having a bar shape. The tongue 42 has a tapered shape as a whole and includes, at its inlet or around the inlet, the introducing part 42A which is spread toward the convergence guide 43.

As illustrated in FIG. 1 and FIG. 2, the wrapping section 15 includes a molding bed (not shown) which extends in a horizontal direction, an endless garniture tape 54 which runs on the molding bed, a wrapping former, a heater, and a cooler, which are not shown. The garniture tape 54 is provided below the tongue 42 and extends below the wrapping former, the heater, and the cooler. The garniture tape 54 adsorbs the rod member (tow 18), which has been molded into a bar in the tongue 42, and sends the rod member to the wrapping section 15.

At the inlet of the wrapping section 15, a paper web 55 is supplied onto the garniture tape 54. The paper web 55 is guided from a paper roll to the garniture tape 54 through a spray gun 56. The spray gun 56 applies an adhesive, that is, rail glue, to a center of the paper web 55 in the width direction of the paper web 55.

The rod member is superposed on the paper web 55 at the inlet of the wrapping section 15. The rod member and the paper web 55 are adhered to each other with the rail glue. Thereafter, the rod member and the paper web 55 run on the molding bed together with the garniture tape 54, and successively pass through the tongue 42, the wrapping former, the heater, and the cooler.

The tongue 42 further compresses the rod member (tow 18) through the garniture tape 54 and the paper web 55, in cooperation with the molding bed. In this processing, a cross section of the rod member is molded to have a circular shape, and the paper web 55 and the garniture tape 54 are bent to have a U-shaped cross section. At this point in time, the lower half of the rod member is covered with the paper web 55.

Thereafter, while the rod member passes through the wrapping former, a side edge part of the paper web 55 is put on one side of the upper half of the rod member with the garniture tape 54, and simultaneously a glue spray (not shown) of the wrapping former applies seam glue to the other side edge of the paper web 55. Then, the other side edge of the paper web 55 is put on the rod member with the garniture tape 54 in the same manner, and superposed on one side edge of the paper web 55 with the seam glue interposed therebetween. At this point in time, the both side edges of the paper web 55 are adhered by the seam glue, and the rod member is entirely wrapped in the paper web 55. Thereby, a filter rod continuous member 57 is formed.

Figure 6:
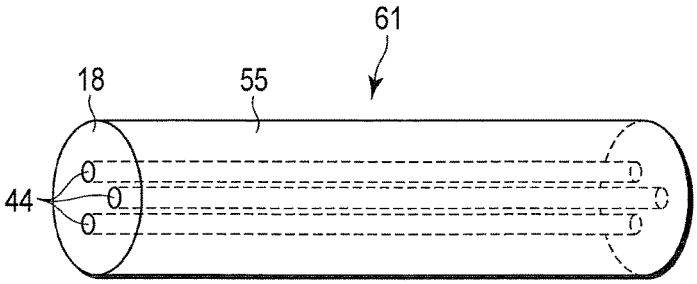
FIG. 6 is a perspective view of a cigarette filter manufactured by the cigarette filter manufacturing apparatus according to the present embodiment.

When the filter rod continuous member 57 passes through the heater and the cooler, the seam glue is successively dried and cooled. The wrapping section 15 includes a rotating knife 58 in a downstream position of the garniture tape 54. The rotating knife 58 cuts the filter rod continuous member 57 into individual filter rods, and thereby cigarette filters 61 as illustrated in FIG. 6 are finished.

Figure 5:
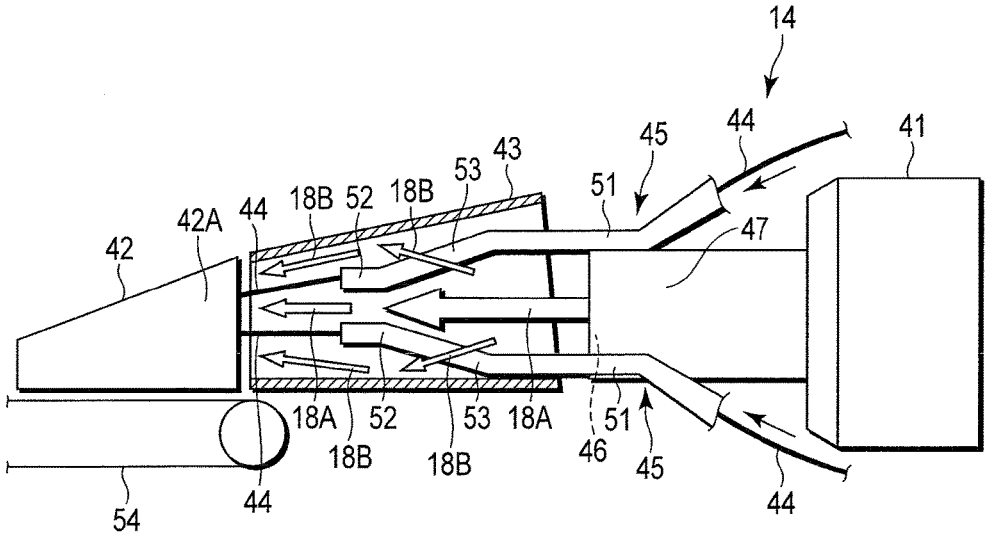
FIG. 5 is a cross-sectional view illustrating a flow of a filter tow passing through the convergence guide illustrated in FIG. 2.

Functions of the thread introducing tubes 45, each of which includes the distal end 52 in the convergence guide 43, and the convergence guide 43 will be explained with reference to FIG. 5. When the tow 18 (filter web 27) is fed from the stuffer jet 41 into the inside space between the thread introducing tubes 45 together with the air, part 18A of the tow 18 is fed toward the space among the distal ends 52 of the thread introducing tubes 45. The other parts 18B of the tow 18 go around to parts outside the distal ends 52 of the thread introducing tubes 45. As described above, since the other parts 18B of the tow 18 go around when the tow 18 passes through the distal ends 52 of the thread introducing tubes 45, the part 18A of the tow located inside the threads 44 and the other parts 18B of the tow located outside the threads 44 have uniform density after the tow has passed through the distal ends 52 of the thread introducing tubes 45. Thus, in the following filter molding step, the threads 44 or the tow 18 do not move, and the threads 44 do not change in position.

In addition, in the cigarette filter manufacturing apparatus according to the present embodiment, the distal ends 52 of the thread introducing tubes 45 extend in a direction parallel with the central axis 41A (the stream of the tow 18) of the stuffer jet 41, as illustrated in FIG. 2. So, the direction in which the threads 44 are let out is defined by the distal ends 52, and a tendency that the threads 44 are concentrated into the central part of the cigarette filter 61 is removed, even when the tow 18 is pulled by the garniture tape 54 in a downstream position.

According to the present embodiment, the cigarette filter manufacturing apparatus 11 comprises the stuffer jet 41 which sends the tow 18 together with air, the tongue 42 which molds the tow 18 into a bar, the convergence guide 43 which is provided in a position between the stuffer jet 41 and the tongue 42 and converges the tow 18 while guiding the tow 18 toward the tongue 42, and a plurality of thread introducing tubes 45, intervals between which are reduced toward the downstream in a position between the outlet 46 of the stuffer jet 41 and the introducing part 42A of the tongue 42, and which supplies respective threads 44 from the respective downstream distal ends 52 into the tow 18.

According to the cigarette filter manufacturing method of the present embodiment, a plurality of threads 44 are supplied from distal ends 52 of the thread introducing tubes 45 which extend such that intervals between them are reduced toward downstream in a position between the outlet 46 of the stuffer jet 41 and the introducing part 42A of the tongue 42, and the tow 18 including the threads 44 are molded into a bar in the tongue 42.

Generally, concentration of the threads 44 into the central part in the cigarette filter 61 deteriorates the appearance of the product, and causes defects such as undesirable transfer of the flavoring contained in one thread 44 to another thread 44.

According to the above structure, the distal ends 52 of the thread introducing tubes 45 extend in parallel with the central axis 41A of the stuffer jet 41 (parallel with the stream of the tow 18), and thus the direction of letting out the threads 44 can be defined by the distal ends 52 when the threads 44 are let out. Thereby, when the filter tow 18 is sent together with the threads 44, the threads 44 do not concentrate in the central part of the cigarette filter 61, and the threads 44 can be arranged at regular intervals in a cross section of the cigarette filter 61. Thereby, the desired flavor can be obtained as a cigarette, and the product can be manufactured with a good appearance.

In addition, in the present embodiment, the distal ends 52 of the thread introducing tubes 45 are arranged in the convergence guide 43. Thus, the distal ends 52 of the thread introducing tubes 45 can be arranged in positions before a part where the density of the tow 18 increases. Thereby, the distal ends of the thread introducing tubes 45 do not prevent the stream of the tow 18, and the frequency of malfunctions, such as the problem that the apparatus is clogged with the tow 18, is reduced. Even when the threads 44 are introduced into the tow 18 in the convergence guide 43, the threads 44 do not move thereafter or have a concentrated arrangement. This is because the filling density is uniform between the tow 18 in the position among the distal ends 52 of the thread introducing tubes 45 and the tow 18 located outside the thread introducing tubes 45, when the tow 18 is sent through the convergence guide 43, and the relative positions of the threads 44 in the cross section of the cigarette filter 61 are not changed even when the whole tow 18 is compressed thereafter in the tongue 42.

Further, according to the present embodiment, the thread introducing tubes 45 are arranged at regular intervals around the outlet 46 of the stuffer jet 41. Thus, the threads 44 can be arranged with a good appearance in the cross section of the cigarette filter 61.

The present invention is not limited to the above embodiment. For example, although the distal ends 52 of the thread introducing tubes 45 are provided in the convergence guide 43 in the above embodiment, the distal ends 52 may be arranged in the introducing part 42A of the tongue 42. Other various modifications can be performed within a range of the gist of the invention, as a matter of course.

REFERENCE SIGNS LIST

11 . . . Cigarette filter manufacturing apparatus, 18 . . . Tow, 41 . . . stuffer jet, 41A . . . Central axis, 42 . . . Tongue, 42A . . . Introducing part, 43 . . . Convergence guide,

44 . . . Thread (string), 45 . . . Thread introducing tube, 46 . . . Outlet, 47 . . . Edge part, 52 . . . Distal end

What is claimed is:

1. A cigarette filter manufacturing apparatus, comprising:

a stuffer jet which sends a tow together with air;

a tongue which molds the tow into a bar;

a convergence guide which is provided in a position between the stuffer jet and the tongue, the convergence guide is separated from the tongue, the convergence guide comprises a plurality of air vents to let the air out, and converges the tow which is sent with air while guiding the tow toward the tongue; and a plurality of thread introducing tubes, each thread introducing tube comprising a bent part and a distal end extending from the bent part, the distal end being shorter than the bent part, each thread introducing tube supplying thread into the tow in a position between an outlet of the stuffer jet and an introducing part of the tongue, distances between the bent parts decreasing downstream of the tow in a position between an outlet of the stuffer jet and an introducing part of the tongue, the distal ends being arranged in the convergence guide, wherein the distal ends of the thread introducing tubes extend parallel with a central axis of the stuffer jet, and wherein the distal ends are provided in positions inner than an edge part of the stuffer jet in a radial direction of the stuffer jet, the edge part defining the outlet of the stuffer jet.

2. The cigarette filter manufacturing apparatus according to claim 1, wherein a space is provided between the distal ends of the thread introducing tubes.

3. The cigarette filter manufacturing apparatus according to claim 1, wherein the thread introducing tubes are arranged around the outlet of the stuffer jet, the distance between the thread introducing tubes is the same as another distance between the thread introducing tubes.

4. The cigarette filter manufacturing apparatus according to claim 1, wherein the distal ends of the plurality of thread introducing tubes are parallel to each other.

5. A cigarette filter manufacturing method, comprising:

supplying a plurality of threads from distal ends of thread introducing tubes, the thread introducing tubes extend such that distances between the thread introducing tubes are substantially reduced toward downstream of the tow, in a position between an outlet of the stuffer jet and an introducing part of the tongue, the distal ends of the thread introducing tubes are provided in a convergence guide location between the stuffer jet and the tongue, each of the distal ends extending from a bent part of the thread introducing tube, and being shorter than the bent part, the distal ends extending parallel with a central axis of the stuffer jet, and provided in positions inner than an edge part of the stuffer jet in a radial direction of the stuffer jet, the edge part defining the outlet of the stuffer jet, the convergence guide is separated from the tongue, the convergence guide comprises a plurality of air vents to let the air out and converges the tow which is sent with air; and molding the tow containing the threads into a bar in the tongue.

6. The cigarette filter manufacturing method according to claim 5, wherein the distal ends of the thread introducing tubes extend in a direction parallel with a stream of the tow sent from the stuffer jet.

7. The cigarette filter manufacturing method according to claim 5, wherein the distal ends of the plurality of thread introducing tubes are parallel to each other.

8. A cigarette filter manufacturing apparatus, comprising:

a stuffer jet which sends a tow together with air, the stuffer jet having a central axis;

a tongue which molds the tow into a bar;

a convergence guide between the stuffer jet and the tongue, the convergence guide converging the tow while guiding the tow toward the tongue; and a plurality of thread introducing tubes, each thread introducing tube comprising a bent part and a distal end extending from the bent part, each thread introducing tube supplying thread into the tow in a position between an outlet of the stuffer jet and an introducing part of the tongue, distances between the bent parts decreasing downstream of the tow in a position between an outlet of the stuffer jet and an introducing part of the tongue, the distal ends being arranged in the convergence guide, wherein the distal ends of the thread introducing tubes extend parallel with the central axis of the stuffer jet, and wherein the distal ends are spaced apart from one another by a distance less than a diameter of an outlet of the stuffer jet.

9. The cigarette filter manufacturing apparatus according to claim 8, wherein each thread introducing tube further comprises a fixed part extending along the stuffer jet.

10. The cigarette filter manufacturing apparatus according to claim 9, wherein each fixed part extends parallel with the central axis of the stuffer jet.

11. The cigarette filter manufacturing apparatus according to claim 8, wherein the plurality of thread introducing tubes is three thread introducing tubes.

* * * * *